US011021339B2

(12) United States Patent
Milbrandt et al.

(10) Patent No.: US 11,021,339 B2
(45) Date of Patent: Jun. 1, 2021

(54) ELASTIC BAND DISPENSER

(71) Applicant: Bedford Industries, Inc., Worthington, MN (US)

(72) Inventors: Jay A. Milbrandt, Worthington, MN (US); Colin M. O'Donnell, Worthington, MN (US)

(73) Assignee: BEDFORD INDUSTRIES, INC., Worthington, MN (US)

( * ) Notice: Subject to any disclaimer, the term of this patent is extended or adjusted under 35 U.S.C. 154(b) by 54 days.

(21) Appl. No.: 15/972,556

(22) Filed: May 7, 2018

(65) Prior Publication Data

US 2018/0334346 A1 Nov. 22, 2018

Related U.S. Application Data

(60) Provisional application No. 62/509,323, filed on May 22, 2017.

(51) Int. Cl.
*B65H 16/00* (2006.01)
*B65D 83/08* (2006.01)

(52) U.S. Cl.
CPC ..... *B65H 16/005* (2013.01); *B65D 83/08* (2013.01); *Y10T 225/247* (2015.04);
(Continued)

(58) Field of Classification Search
CPC . Y10T 225/12; Y10T 225/30; Y10T 225/252; Y10T 225/35; Y10T 225/393;
(Continued)

(56) References Cited

U.S. PATENT DOCUMENTS 92,895 A 7/1869 Southworth
109,263 A 11/1870 Southworth
(Continued)

FOREIGN PATENT DOCUMENTS

AU 2011224038 10/2011
CN 204632247 9/2015
(Continued)

OTHER PUBLICATIONS

International Search Report and Written Opinion in Applicant's corresponding application PCT/US2018/031741, dated Jul. 27, 2018.
(Continued)

*Primary Examiner* — Laura M Lee
(74) *Attorney, Agent, or Firm* — Mai-Tram D. Lauer; Westman, Champlin & Koehler, P.A.

(57) ABSTRACT

A dispenser is configured for use with a chain of rupturably connected elastic bands, each of the bands having an aperture. The dispenser includes a fixed convex surface and a stop element. The chain of bands is configured to be drawn over the fixed convex surface in a direction from a first side to a second side of the surface. The stop element is positioned proximate the second side of the surface and is configured for insertion into the aperture of one of the elastic bands. In another aspect, an assembly is configured for use with a chain of rupturably connected elastic bands. The chain is provided on a spool, and each of the bands has an aperture therethrough. The assembly includes a dispenser and a shaft configured to support the spool. A method is described for dispensing elastic bands from a chain of rupturably connected elastic bands.

13 Claims, 9 Drawing Sheets

(52) U.S. Cl.
CPC ..... *Y10T 225/253* (2015.04); *Y10T 225/254* (2015.04); *Y10T 225/393* (2015.04)

(58) Field of Classification Search
CPC . Y10T 225/247; Y10T 225/20; Y10T 225/29; Y10T 225/287; Y10T 225/269; Y10T 225/297; Y10T 225/253; A47F 2009/044; A47F 9/042; B65H 35/10; B65H 2701/191; B65H 16/005; B26F 3/02; B26F 3/002; B65B 69/0025; B65D 83/03
USPC ..... 225/66, 82, 84, 90, 106, 53, 47; 206/390, 805
See application file for complete search history.

(56) References Cited

U.S. PATENT DOCUMENTS 134,116 A 12/1872 West
161,145 A 3/1875 Moder
212,578 A 2/1879 Smith
224,958 A 2/1880 Rowland
263,600 A 8/1882 Searing
381,879 A 4/1888 Howard
D28,619 S 5/1898 McFadden
D44,124 S 6/1913 Clements
1,221,572 A 4/1917 Morton
1,397,079 A 11/1921 Cohen
D63,105 S 10/1923 King
D64,864 S 6/1924 Pitney
1,830,410 A 11/1931 Shaaf
1,926,553 A 9/1933 Morse
1,929,320 A 10/1933 Lulham
1,995,280 A 3/1935 Everhart
2,054,641 A 9/1936 Stone
2,057,618 A 10/1936 Keith
D114,257 S 4/1939 Blanchard
2,175,835 A * 10/1939 Fraser ..... A47F 13/04 225/77
2,194,220 A 3/1940 Elder
2,194,898 A 3/1940 Hanford
D123,663 S 11/1940 Bristol
2,298,191 A 10/1942 Boh
2,328,522 A * 8/1943 Yocum ..... B65H 75/06 206/495
2,362,523 A 11/1944 Armstrong
2,382,522 A 8/1945 Trotter
2,516,292 A 7/1950 Bennett
2,516,929 A 8/1950 Van Ackeren
2,635,604 A 4/1953 Fredrickson
2,669,047 A 2/1954 Rieger
2,790,609 A * 4/1957 Hawthorne ..... B65H 35/0026 225/26
2,906,398 A * 9/1959 Springer ..... B65D 75/5833 206/338
2,937,464 A 5/1960 Marshall
2,979,192 A 4/1961 Blonder
3,035,345 A * 5/1962 Barnard ..... B65H 35/0026 225/14
3,077,683 A 2/1963 Jones
3,164,250 A 1/1965 Paxton
3,436,719 A 4/1969 Sheinbaum
3,545,795 A 12/1970 Hertel
3,602,957 A 9/1971 Chang
3,603,551 A 9/1971 Peterson
3,621,809 A 11/1971 Paxton
3,635,367 A 1/1972 Morita
3,662,480 A 5/1972 Gilson
3,744,658 A 7/1973 Fujio
3,749,622 A 7/1973 Sato
3,765,113 A 10/1973 Magee
3,777,378 A 12/1973 Sant'Anselmo
3,783,083 A 1/1974 Jenkins
3,807,679 A 4/1974 Burke
3,885,724 A 5/1975 Ehrlund
3,896,524 A 7/1975 Parker
3,903,601 A 9/1975 Anderson
3,930,506 A 1/1976 Overend
3,933,560 A 1/1976 Muttera
3,955,656 A 5/1976 Kashinski
4,047,652 A * 9/1977 Ehrlund ..... G07B 3/02 225/54
4,079,875 A 3/1978 Zodrow
4,119,449 A 10/1978 Gould
D251,121 S 2/1979 Smith
4,194,658 A * 3/1980 Tschudin ..... A47K 10/38 225/65
4,296,861 A 10/1981 Barrash
4,323,608 A 4/1982 Denny
4,341,303 A 7/1982 Britt
4,362,239 A 12/1982 Roccaforte
4,363,401 A 12/1982 Savagian
4,390,095 A 6/1983 Cunningham
4,407,082 A 10/1983 Stehouwer
4,412,624 A 11/1983 Tanaka
4,413,741 A 11/1983 Curchack
4,433,498 A 2/1984 Bienz
4,436,510 A 3/1984 Klein
4,460,143 A 7/1984 Ohama
4,519,178 A 5/1985 Crabb
4,529,229 A 7/1985 Glibbery
4,540,619 A 9/1985 Watanabe
4,706,804 A 11/1987 Hall
4,712,671 A 12/1987 Salacuse
4,738,384 A * 4/1988 Tigner ..... A63F 3/065 225/16
4,749,426 A 6/1988 Wyss
4,916,841 A 4/1990 Dawson
5,005,730 A * 4/1991 Pickrell, Jr. ..... A61C 7/306 221/71
5,018,286 A 5/1991 Zahner
5,087,306 A 2/1992 Cheung
5,131,614 A 7/1992 Garcia
5,170,957 A 12/1992 Carpenter
5,207,746 A 5/1993 Jones
5,221,033 A 6/1993 Klein
D338,195 S 8/1993 Sugarman
RE34,366 E 9/1993 Instance
5,248,164 A 9/1993 Lepretre
5,267,644 A 12/1993 Tsao
5,279,019 A 1/1994 Knickle
5,292,566 A 3/1994 Shacklett
5,294,034 A * 3/1994 Svensson ..... B65C 11/00 225/106
5,322,724 A 6/1994 Levens
5,344,006 A 9/1994 Mazzeo
5,348,781 A 9/1994 Koblella
5,363,576 A 11/1994 Piana
5,367,752 A 11/1994 Petty
RE34,856 E 2/1995 Daniels
5,388,739 A 2/1995 Gargan
5,390,794 A 2/1995 Vulpitta
5,467,897 A 11/1995 Williams
5,490,658 A 2/1996 Coward
5,493,801 A 2/1996 James
5,531,696 A 7/1996 Menes
5,617,656 A 4/1997 Ludlow
5,667,070 A 9/1997 Miret
D385,581 S 10/1997 Linz
D386,211 S 11/1997 Taparauskas
5,683,194 A 11/1997 Emmel
5,697,177 A 12/1997 Ludlow
5,700,537 A 12/1997 Instance
5,713,467 A 2/1998 Kao
5,733,652 A 3/1998 Stowman
5,735,394 A 4/1998 Harrelson
5,755,369 A * 5/1998 Holmes ..... B26F 3/002 206/214
5,766,917 A 6/1998 Wallach et al.
5,778,583 A 7/1998 Larsen
5,782,495 A 7/1998 Grosskopf
5,866,219 A 2/1999 McClure
6,024,225 A 2/2000 Van der Donk
6,036,234 A 3/2000 Chess

(56) References Cited

U.S. PATENT DOCUMENTS

| | | | | |
|---|---|---|---|---|
| 6,058,639 | A | 5/2000 | Tinklenberg | |
| 6,073,758 | A | 6/2000 | Webster | |
| 6,076,669 | A | 6/2000 | Ling | |
| D428,930 | S | 8/2000 | Dunlap | |
| 6,116,653 | A | 9/2000 | Oberholzer | |
| 6,145,722 | A * | 11/2000 | Behrens | B65H 35/0026 206/403 |
| 6,146,731 | A | 11/2000 | Tanoto | |
| 6,186,737 | B1 * | 2/2001 | Cohen | B65H 54/68 206/303 |
| 6,270,834 | B1 | 8/2001 | Burrows | |
| 6,271,631 | B1 | 8/2001 | Burrows | |
| 6,279,255 | B1 | 8/2001 | Larsen | |
| 6,321,965 | B1 | 11/2001 | Lavi | |
| 6,355,403 | B1 | 3/2002 | Bourdelais | |
| 6,378,700 | B1 | 4/2002 | Tong | |
| 6,381,890 | B1 | 5/2002 | Sjostedt | |
| 6,413,122 | B2 | 7/2002 | Fujioka | |
| 6,449,886 | B1 | 9/2002 | Gray | |
| 6,481,594 | B1 | 11/2002 | Yeh | |
| 6,490,821 | B1 | 12/2002 | Lacek | |
| 6,688,023 | B1 | 2/2004 | Gwen | |
| 6,701,532 | B1 | 3/2004 | Glassberg | |
| D494,066 | S | 8/2004 | Liu | |
| D494,998 | S | 8/2004 | Blanke | |
| 6,810,811 | B2 | 11/2004 | Grounds | |
| D501,892 | S | 2/2005 | Perry | |
| D504,766 | S | 5/2005 | Cassinelli | |
| 6,991,261 | B2 | 1/2006 | Dronzek | |
| 6,994,246 | B2 | 2/2006 | Ichikawa | |
| 7,086,545 | B2 | 8/2006 | Mannion | |
| D532,049 | S | 11/2006 | Ludlow | |
| 7,143,892 | B2 | 12/2006 | Kolton | |
| 7,281,345 | B2 | 10/2007 | Ludlow | |
| D555,723 | S | 11/2007 | Farr | |
| 7,763,135 | B1 | 7/2010 | Maltas | |
| 7,836,622 | B1 | 11/2010 | King | |
| 7,861,861 | B2 * | 1/2011 | Mesika | A45C 11/24 206/476 |
| 7,922,022 | B2 | 4/2011 | Ciarrocchi | |
| 8,047,387 | B2 | 11/2011 | Chalekian | |
| 8,083,126 | B2 | 12/2011 | Fleming | |
| D686,415 | S | 7/2013 | Sassi | |
| D693,813 | S | 11/2013 | Symons | |
| 8,635,795 | B2 | 1/2014 | Ludlow | |
| D712,154 | S | 9/2014 | Schiller | |
| D723,621 | S | 3/2015 | Heinrichs | |
| 9,248,469 | B2 | 2/2016 | Spreck | |
| D756,022 | S | 5/2016 | Shipman | |
| D756,028 | S | 5/2016 | Shipman | |
| 9,355,577 | B1 | 5/2016 | Coleman | |
| D762,985 | S | 8/2016 | Schiller | |
| 9,676,536 | B2 | 6/2017 | Milbrandt | |
| 2002/0160896 | A1 | 10/2002 | Yeh | |
| 2003/0096076 | A1 | 5/2003 | Allison | |
| 2003/0150919 | A1 | 8/2003 | Blank | |
| 2004/0028865 | A1 | 2/2004 | Sellars | |
| 2004/0245042 | A1 | 12/2004 | Nevill | |
| 2005/0138854 | A1 | 6/2005 | Simmons | |
| 2005/0166439 | A1 | 8/2005 | Ludlow | |
| 2005/0173073 | A1 | 8/2005 | Chemoff | |
| 2005/0255277 | A1 | 11/2005 | Syron | |
| 2006/0086028 | A1 | 4/2006 | Vaughan | |
| 2006/0091091 | A1 | 5/2006 | Tuan Mu | |
| 2006/0147668 | A1 | 7/2006 | Hirose | |
| 2006/0272185 | A1 | 12/2006 | Malama | |
| 2007/0020423 | A1 | 1/2007 | Chamandy | |
| 2007/0131569 | A1 | 6/2007 | Cotsalas | |
| 2007/0173343 | A1 | 7/2007 | Turnpaugh | |
| 2008/0135573 | A1 | 6/2008 | Cotsalas | |
| 2008/0272011 | A1 | 11/2008 | Levy | |
| 2008/0296192 | A1 | 12/2008 | Tokie | |
| 2008/0301853 | A1 | 12/2008 | Cummiskey | |
| 2009/0152860 | A1 | 6/2009 | Bridges | |
| 2009/0188144 | A1 | 7/2009 | Ludlow | |
| 2010/0006587 | A1 | 1/2010 | Newmark | |
| 2010/0035010 | A9 | 2/2010 | Sellars | |
| 2010/0072794 | A1 | 3/2010 | Karovic | |
| 2010/0139133 | A1 | 6/2010 | Adams | |
| 2012/0125970 | A1 * | 5/2012 | Tsui | A47F 13/085 225/106 |
| 2013/0239449 | A1 | 9/2013 | Heinrichs | |
| 2014/0174970 | A1 | 6/2014 | Saville | |
| 2015/0136801 | A1 | 5/2015 | Fisher | |
| 2017/0372643 | A1 | 12/2017 | Milbrandt | |

FOREIGN PATENT DOCUMENTS

| | | |
|---|---|---|
| DE | 9206368 | 8/1992 |
| DE | 4402285 | 10/1994 |
| EP | 1136971 | 9/2001 |
| FR | 2634574 | 1/1990 |
| GB | 451036 | 7/1936 |
| GB | 2255985 | 11/1992 |
| GB | 2382810 | 6/2003 |
| GB | 2405854 | 3/2005 |
| JP | H07246799 A | 9/1995 |
| JP | 2002347841 | 12/2002 |
| NL | 1016806 | 6/2002 |
| WO | 9824086 | 6/1998 |
| WO | 0026109 | 5/2000 |
| WO | 2007084119 | 7/2007 |
| WO | 2014036246 | 3/2014 |

OTHER PUBLICATIONS

Translation of JP-2002347841 patent, Container with Neck Hanging Label, Publication Date: Dec. 4, 2002.

Cox, H., "Elasticity and strength of paper and other fibrous materials," Br. J. Appl. Phys. 3(72), Mar. 1952, available at http://iopscience.iop.org/0508-3443/3/3/302.

Colom, A., "Analysis of the shape of a sheet of paper when two opposite edges are joined," Am. J. Phys. 74(7), Jul. 2006, available at http://sci-toys.com/bent_paper_problem.pdf.

* cited by examiner

ELASTIC BAND DISPENSER

CROSS-REFERENCE TO RELATED APPLICATION

This application claims the benefit of priority from U.S. Provisional Patent Application No. 62/509,323, filed May 22, 2017; this priority application is hereby incorporated by reference in its entirety.

BACKGROUND

Endless elastic loops commonly called rubber bands are well known for bundling items together. Such rubber bands are typically provided in a package (such as a bag or box, for example) in which many rubber bands are jumbled together. Because of their elongated loop configurations, the bands often tangle with each other into a mass from which it can be difficult to separate a single band for use. When using rubber bands in an industrial setting, such as a packaging operation in which the bands are used for bundling or closing items in an industrial process, manual handling of rubber bands can take more time than desired because of the inherent difficulty described above.

SUMMARY

In one aspect, a dispenser is configured for use with a chain of rupturably connected elastic bands, each of the bands having an aperture therethrough. The dispenser includes a fixed convex surface and a stop element. The chain of bands is configured to be drawn over the fixed convex surface in a direction from a first side of the surface to a second side of the surface. The stop element is positioned proximate the second side of the surface, and the stop element is configured for insertion into the aperture of one of the elastic bands.

In another aspect, an assembly is configured for use with a chain of rupturably connected elastic bands. The chain is provided on a spool, and each of the bands has an aperture therethrough. The assembly includes a dispenser and a shaft. The dispenser includes a fixed convex surface and a stop element. The chain of bands is configured to be drawn over the fixed convex surface in a direction from a first side of the surface to a second side of the surface. The stop element is positioned proximate the second side of the surface, and the stop element is configured for insertion into the aperture of one of the elastic bands. The shaft is configured to support the spool.

In yet another aspect, a method is described for dispensing elastic bands from a chain of rupturably connected elastic bands using a dispenser assembly. Each of the bands has an aperture therethrough, and the chain is provided on a spool. The method includes mounting the spool on a shaft of the assembly; positioning a portion of the chain over a fixed convex surface of the assembly; pulling the chain in a direction from a first side of the surface to a second side of the surface so that first and second elastic bands of the chain are pulled past the second side of the surface; and inserting a stop element into the aperture of the second elastic band, so that the first elastic band is outside the dispenser assembly.

This disclosure, in its various combinations, either in apparatus or method form, may also be characterized by the following listing of items:

1. A dispenser configured for use with a chain of rupturably connected elastic bands, each of the bands having an aperture therethrough, wherein the dispenser includes:
   - a fixed convex surface over which the chain of bands is configured to be drawn in a direction from a first side of the surface to a second side of the surface; and
   - a stop element positioned proximate the second side of the surface, wherein the stop element is configured for insertion into the aperture of one of the elastic bands.

2. The dispenser of item 1 wherein the fixed convex surface and stop element are positioned on a base, the dispenser further including a cover movably attached to the base.

3. The dispenser of item 2, wherein a portion of a chain travel path for the chain of rupturably connected elastic bands is defined between the cover and the fixed convex surface.

4. The dispenser of item 3, wherein the chain travel path includes a gap between the stop element and the cover.

5. The dispenser of any of items 2-4, wherein the cover is movable relative to the base between a closed position and an open position.

6. The dispenser of any of items 2-5, wherein the cover has an interior concave surface.

7. The dispenser of any of items 2-6, wherein the cover is pivotally attached to the base.

8. The dispenser of any of items 1-7, wherein the fixed convex surface is located on a protrusion.

9. An assembly configured for use with a chain of rupturably connected elastic bands, the chain provided on a spool, each of the bands having an aperture therethrough, wherein the assembly includes:

a dispenser including:
   - a fixed convex surface over which the chain of bands is configured to be drawn in a direction from a first side of the surface to a second side of the surface; and
   - a stop element positioned proximate the second side of the surface, wherein the stop element is configured for insertion into the aperture of one of the elastic bands; and a shaft configured to support the spool.

10. The assembly of item 9, further including a mount on which the dispenser and shaft are attached.

11. The assembly of item 10, wherein the mount includes a wall on which the dispenser and shaft are attached.

12. The assembly of item 11, wherein the mount further includes a floor oriented substantially perpendicular to the wall.

13. The assembly of any of items 9-12, further including a handle.

14. The assembly of any of items 9-13, wherein the fixed convex surface and stop element are positioned on a base, and wherein the shaft is positioned below the base.

15. The assembly of any of items 9-14, wherein the fixed convex surface and stop element are positioned on a base, and wherein the shaft is positioned above the base.

16. A method for dispensing elastic bands from a chain of rupturably connected elastic bands with a dispenser assembly, each of the bands having an aperture therethrough, the chain being provided on a spool, the method including:
   - mounting the spool on a shaft of the assembly;
   - positioning a portion of the chain over a fixed convex surface of the assembly;
   - pulling the chain in a direction from a first side of the surface to a second side of the surface so that first and second elastic bands of the chain are pulled past the second side of the surface; and inserting a stop element into the aperture of the second elastic band, so that the first elastic band is outside the dispenser assembly.

17. The method of item 16, further including pulling the first elastic band to sever a connection between the first elastic band and the second elastic band.

18. The method of any of items 16-17, further including:

lifting the second elastic band to free its aperture from the stop element;

pulling the chain in the direction; and inserting the stop element into the aperture of a third elastic band, so that the second elastic band is outside the dispenser assembly.

19. The method of any of items 16-18 wherein the fixed convex surface and stop element are positioned on a base, the dispenser assembly further including a cover movably attached to the base, the method further including closing the cover relative to the base.

20. The method of item 19 wherein closing the cover relative to the base includes pivoting the cover about a pivot axis.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

A hinged dispenser is described for a strip of elastic bands, which can be provided on a spool. The dispenser includes a convex protrusion or "hump" over which the bands travel, with a stop element such as a pin or peg at an end of the protrusion. In use, the stop element holds the penultimate band so that a user can pull on the last band to detach it from the strip of bands (such as at perforations between individual bands). To reset for the next use, the user pulls up on the last connected band and slips it over the stop element to allow the next band (now the penultimate band) to fall down and loop around the stop element.

While other dispensers for spooled items are known, the current concept offers advantages in use over devices in which the spool itself constitutes a hump over which the items are carried. In contrast to a rotating roll or spool that continually changes position and size, the use of a stationary protrusion of stable dimension allows for optimization of band motion thereover.

Figure 1:
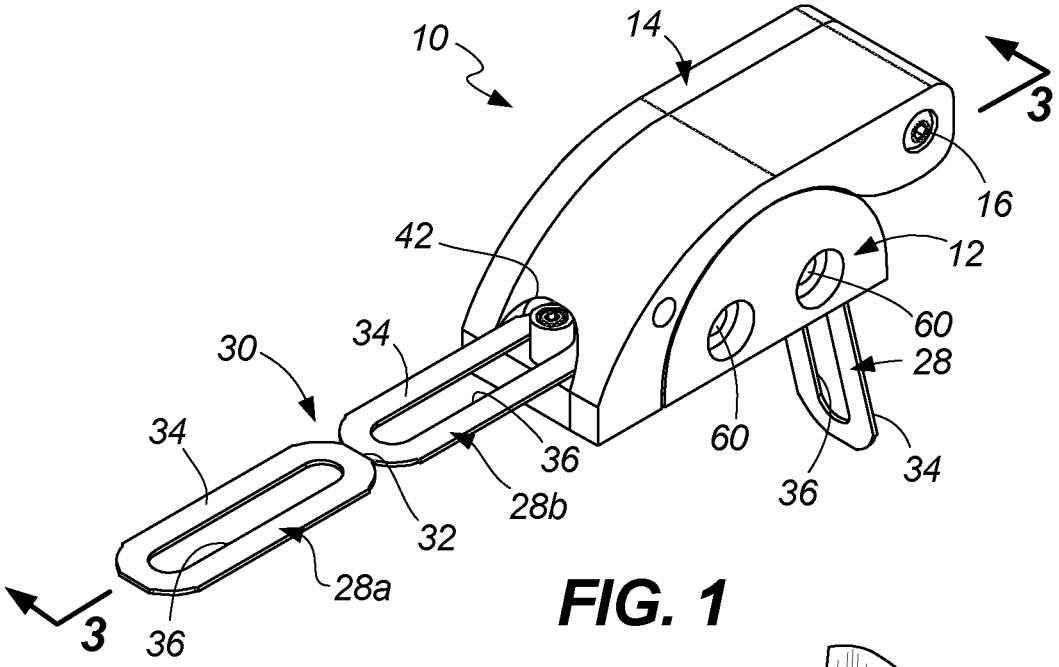
FIG. 1 is a perspective view of an exemplary dispenser in a closed configuration.
Figure 2:
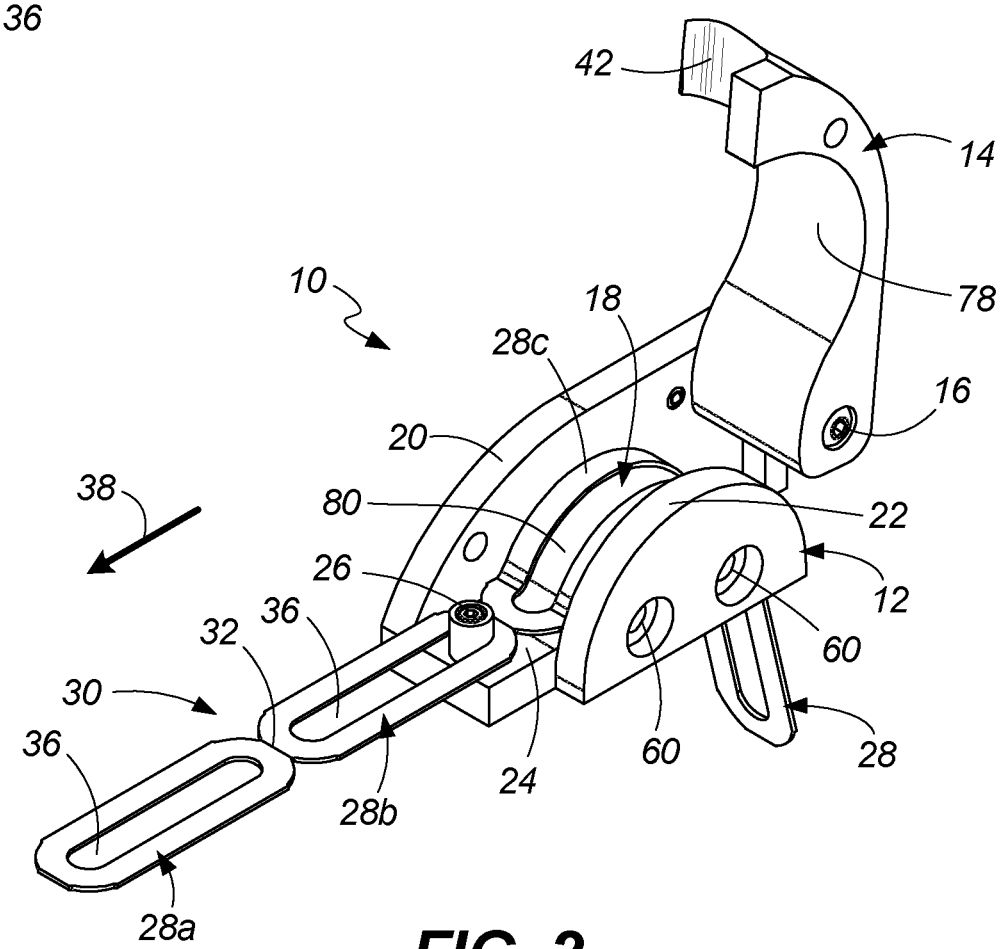
FIG. 2 is a perspective view of an exemplary dispenser in an open configuration.

FIGS. 1 and 2 show perspective views of closed and opened configurations, respectively, of an exemplary elastic band dispenser 10. In an exemplary embodiment, dispenser 10 includes base 12 and cover 14. In the illustrated embodiment, cover 14 is pivotally connected to base 12 at hinge pin 16. Base 12 is formed with a stationary convex protrusion 18 between left wall 20 and right wall 22. Protrusion 18 is contiguous with floor 24 of base 12. Stop element 26 extends upwardly from floor 24 and is positioned in fixed relation to protrusion 18. In an exemplary embodiment, stop element 26 is provided in the formed of a pin, peg, stud or like element.

Dispenser 10 is configured for use with a chain 30 of rupturably connected elastic or elastomeric bands 28, each of the bands 28 having an aperture 36 therethrough. Dispenser 10 includes a fixed convex protrusion 18 having a surface 80 over which the chain of bands 30 is configured to be pulled in a direction 39 (labeled in FIG. 3B) from a first side 82 of the surface 80 to a second side 84 of the surface 80. In an exemplary embodiment, protrusion 18 is fixed in size and location to provide a consistent surface 80 upon which chain 30 travels. Thus, surface 80 can be optimized for chain travel in terms of shape, size, surface texture and other properties. This is in contrast to common dispenser rolls, in which a spool of material rotates on a shaft. In that case, the spool constantly changes in position as it turns, and changes in dimension as material is removed, so that the dispensing operation is not consistent.

In an exemplary embodiment of dispenser 10, a stop element 26 is positioned proximate the second side 84 of the surface 80 and is configured for insertion into the aperture 36 of one of the elastomeric bands 28. In an exemplary embodiment, adjacent bands 28 are rupturably connected to each other at their ends 32. Protrusion 18 and stop element 26 are positioned in base 12. Dispenser 10 further includes cover 14 movably attached to base 12. Cover 14 includes interior concave surface 78.

Figure 3A:
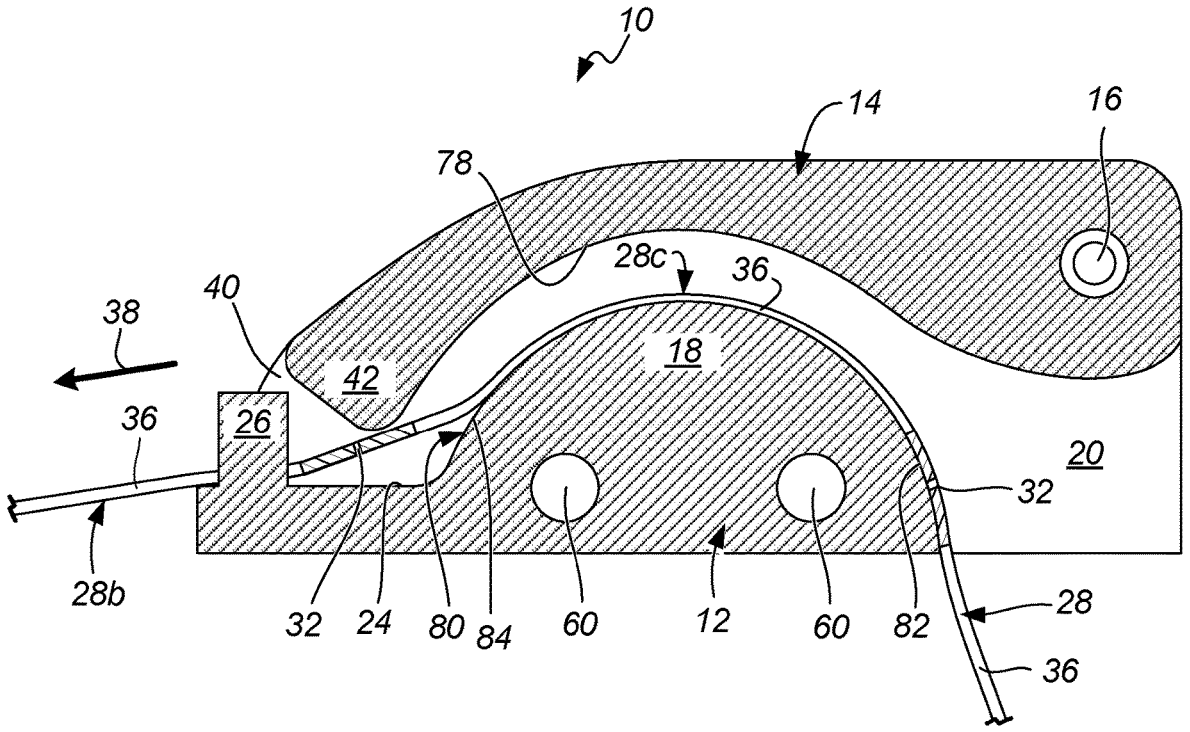
FIG. 3A is a cross-sectional view taken along line 3-3 of FIG. 1.
Figure 3B:
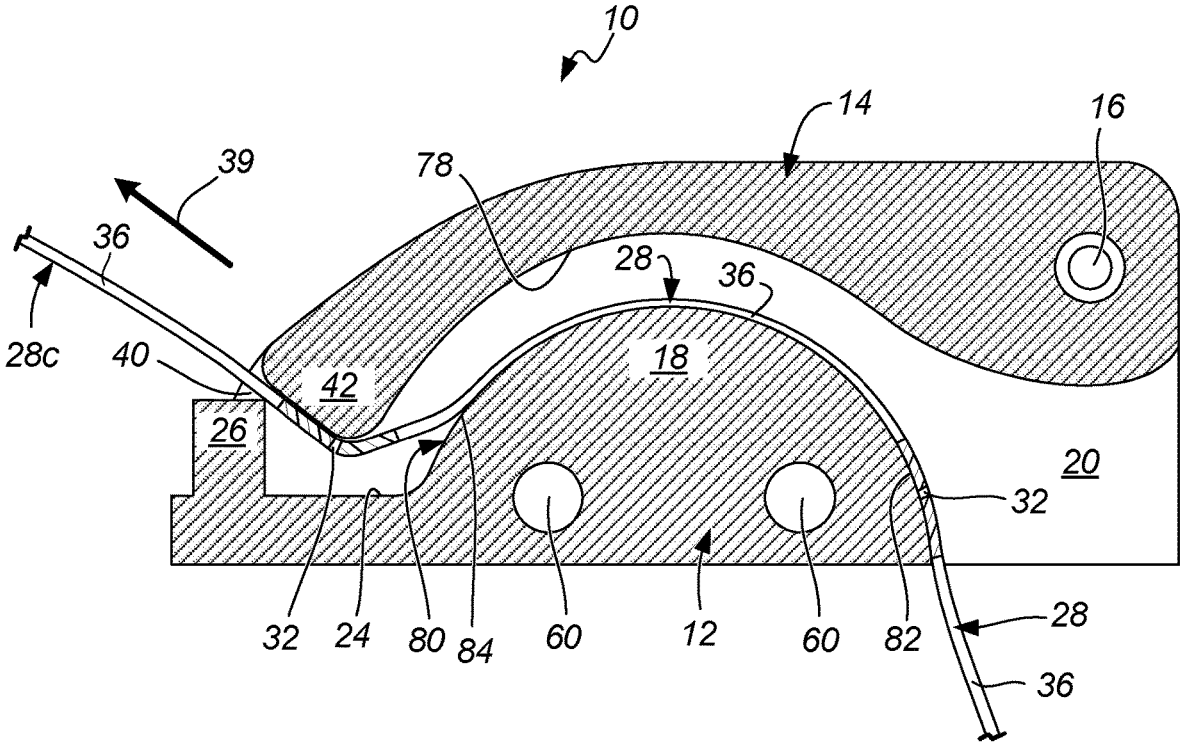
FIG. 3B is similar to FIG. 3A but shows an upward pulling of a strip of elastic bands.

As shown in FIGS. 1, 2, 3A and 3B, a portion of a chain travel path is defined between cover 14 and protrusion 18. The chain travel path includes gap 40 between stop element 26 and cover 14. As illustrated in FIGS. 1-3A, penultimate band 28*b* is restrained from further motion in direction 38 by stop element 26, which is inserted into aperture 36 of band 28*b*. As shown in FIG. 1, with penultimate band 28*b* so restrained, a user can gently pull upon the last band at 28*a* to separate it from the penultimate band 28*b* at rupturable joints 74 (labeled in FIGS. 7, 12 and 13) at the common ends 32 of the adjacent connected bands 28*a*, 28*b*. As shown in FIG. 3B, to dispense the next connected band 28, a user may lift up on the constrained band 28*b* and pull in direction 39 to allow passage of the strip 30 through gap 40 between stop element 26 and cover 14. Then, the next elastic band at 28*c* is lowered so that its aperture 36 is held on stop element 26, and now the last band 28*b* is unconstrained and available for removal from the strip 30.

In the illustrated embodiment, cover 14 is configured with curved end 42 that is shaped to press downwardly on elastic strip 30 to prevent unintentional disengagement of the constrained band 28*b* from stop element 26. However, the shape of curved end 42 is preferably smooth to prevent unintentional breaking of adjacent bands at the joints at ends 32 when strip 30 is pulled past curved end 42 in direction 39, as shown in FIG. 3B. As shown in FIGS. 1 and 2, a gap 40 is provided between curved end 42 and stop element 26 to allow for the passage of elastic bands 28 over and around stop element 26.

As shown in FIG. 2, cover 14 can be pivoted upward from protrusion 18 to allow a user to place or replace elastic strip 30 in dispenser 10. While a pivoting relation is shown between cover 14 and base 12, other structures providing for relative motion are also suitable (e.g., sliding, complete detachment). An elastic strip 30 of indeterminate length can be provided in a convenient package such as spool, for example. Accordingly, dispenser 10 can be incorporated into any of a number of assemblies, such as an assembly including a support for holding such a spool.

Figure 4:
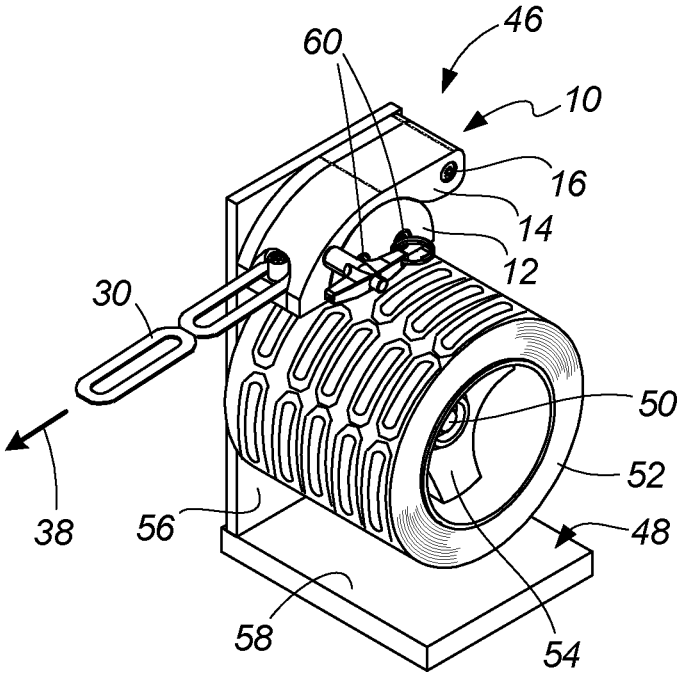
FIG. 4 is a perspective view of a first exemplary embodiment of an assembly including the dispenser FIG. 1.
Figure 5:
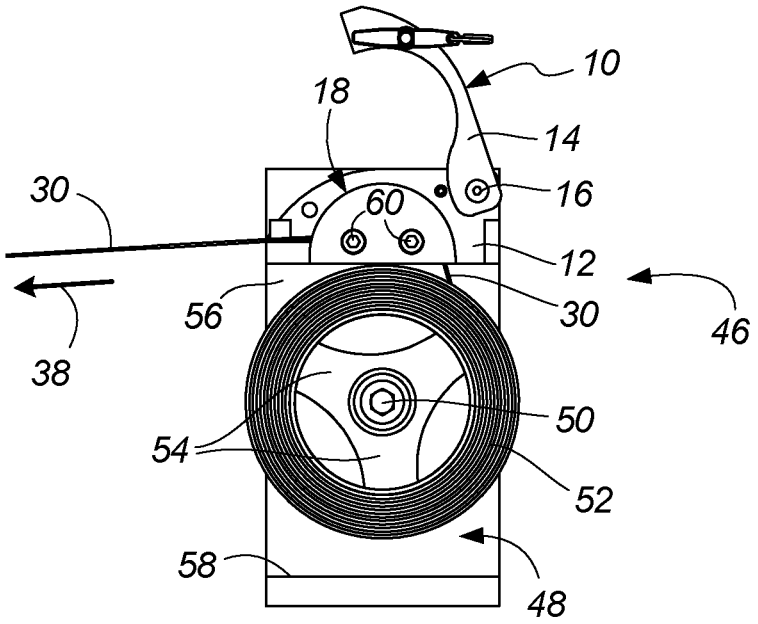
FIG. 5 is a side elevation view of the dispenser assembly of FIG. 4 in an open configuration.

FIGS. 4 and 5 show a first exemplary assembly 46 including dispenser 10 on a mount 48 including a shaft 50 configured to support spool 52 of elastic strip 30. Such a spool 52 is further described with reference to FIG. 8, below. Because spool 52 has a relatively large core diameter, radially extending arms 54 can be provided on shaft 50 for holding spool 52 in a centered and stable arrangement. Shaft 50 is positioned below base 12 in a manner that allows chain 30 to be pulled in direction 39 from a first side 82 of protrusion 18 (labeled in FIG. 3B) to a second side 84 of the protrusion 18. In an exemplary embodiment, mount 48 includes wall 56 and floor 58, wherein floor 58 is oriented substantially perpendicular to wall 56. In an exemplary method of attachment of dispenser 10 to mount 48, mechanical fasteners such as bolts can be inserted through apertures 60 of dispenser 10 and into wall 56 of mount 48, for example. Shaft 50 can be similarly mounted on wall 56. Assembly 46 may rest upon a horizontal surface such as a table or counter. Alternatively, assembly 46 can be attached by the use of mechanical, adhesive or other fasteners to connect wall 56 or floor 58 of assembly 46 to suitable vertical or horizontal surfaces in a desired location.

Figure 6:
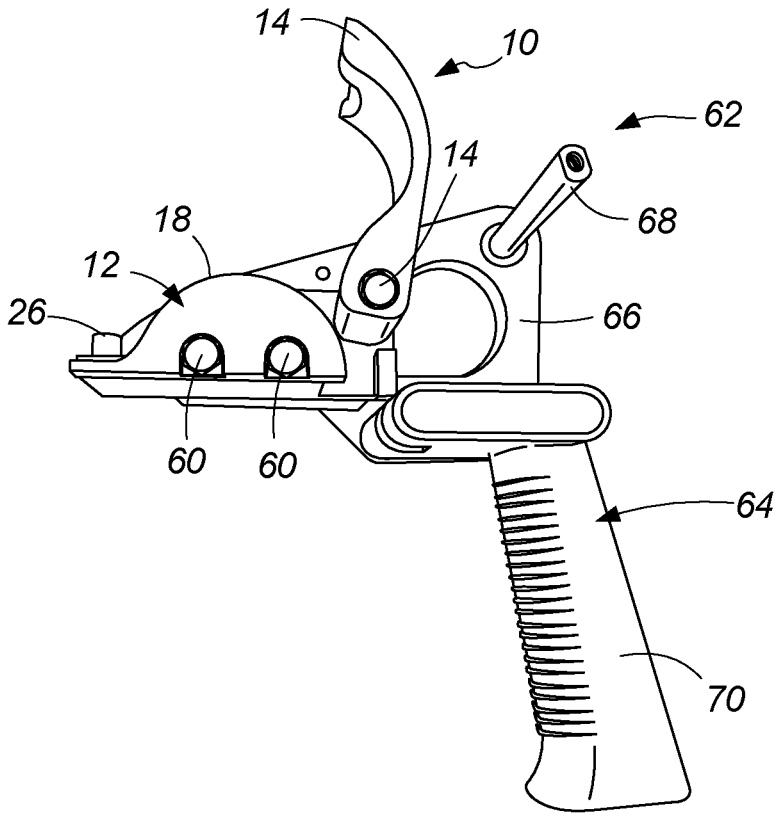
FIG. 6 is a side view of a second exemplary dispenser assembly of the present disclosure.

FIG. 6 is a side view of a second exemplary assembly 62 including dispenser 10. In assembly 62, dispenser 10 is connected to a hand-held device 64, such as by the use of mechanical fasteners such as bolts through apertures 60 of base 12. Shaft 68 is positioned above and to the side of base 12 in a manner that allows chain 30 (see FIG. 3B) to be pulled in direction 39 from a first side 82 of protrusion 18 to a second side 84 of the protrusion 18. Hand-held device 64 includes mounting wall or plate 66 on which such fasteners through apertures 60 are attached. Shaft 68 supports a spool 52, 72 (shown in FIGS. 8, 9) for dispensing of elastic bands 28 of elastic strip 30 from dispenser 10. Handle 70 provides a grip for a user.

Figure 7:
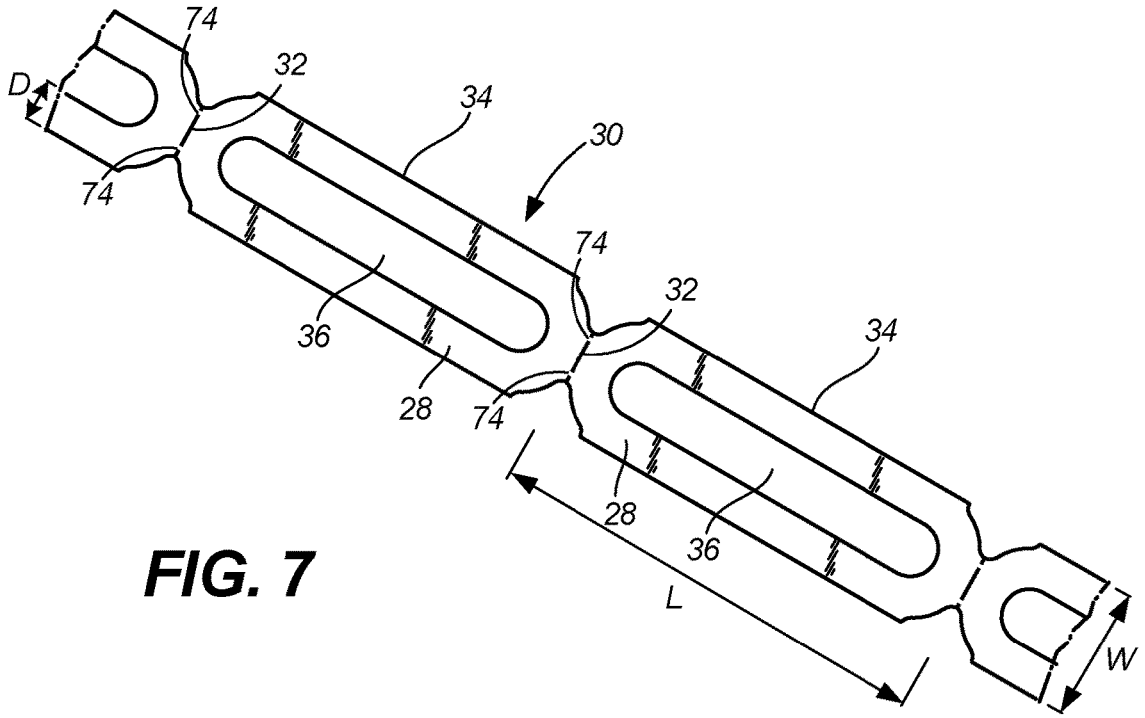
FIG. 7 is a top view of a portion of an elastic strip of indeterminate length consisting of a plurality of rupturably connected elastic bands.

As shown in FIG. 7, in an exemplary embodiment, elastic band strip 30 is configured as a layer of flexible elastomer material cut into a plurality of ruptureably connected elastic bands 28. Such cutting can be performed by a laser cutting apparatus, for example. Any number of connected bands 28 can be provided in a package such as spool 52 of FIG. 8 or spool 72 of FIG. 9 (or in some other dispensing arrangement, such as a fan-folded stack, for example), to form a package of convenient size, weight, and number of individual bands 28 for a particular application.

In an exemplary embodiment, elastic strip 30 is cut so that each elastic band 28 is attached to an adjacent elastic band 28 at joints 74 at adjacent ends 32. In an exemplary embodiment, an elastic band 28 is substantially configured as a loop surrounding aperture 36 and having length dimension L and width dimension W. In an exemplary embodiment, a length L of an elastic band extends between opposite ends 32. In the illustrated embodiment, joints 74 are located at end 32 of each elastic band 28 and are configured as small, at least partially uncut pieces of elastic material.

In an exemplary embodiment, each elastic band 28 is formed to have a width W that is less than its length L (wherein W and L are measured in substantially perpendicular directions). While a particular configuration is illustrated for elastic bands 28, it is contemplated that other flat band shapes are also suitable, including for example, oval, oblong, elliptical, circular, and other closed polygonal and curved shapes, whether symmetrical or asymmetrical. Aperture 36 can be shaped other than oblong. In the illustrated embodiment, elastic band 28 has a substantially consistent dimension D between outer perimeter cut 34 and aperture 36. However, it is contemplated that in other embodiments, such a dimension need not be substantially consistent.

In an exemplary embodiment, band strip 30 is sheet-like in the sense that it is formed of a web of elastomeric material that is flat in character, although it may be drapeable and floppy and thus not always displayed in flat form. In an exemplary embodiment, elastic band strip 30 has a thickness less than about 100 mils (2.54 mm) and more commonly about 10 mils (0.25 mm) to about 35 mils (0.89 mm).

While the illustrated embodiment shows two joints 74 connecting each elastic band 28 to an adjacent elastic band 28, it is contemplated that other configurations of joining mechanisms can also be used, including for example, perforations, score lines, cut lines of full or partial depth, and other mechanisms for forming a ruptureable line or contour of weakness connecting the adjacent elastic bands 28. Moreover, while a particular shape and configuration of the joint 74 between the elastic bands 28 is illustrated, it is contemplated that other forms and shapes can be used. As shown in FIG. 7, an outer perimeter cut 34 is provided around each elastic band 28, except in the areas of joint 74.

Upon breaking an individual elastic band 28 from elastic strip 30, elastic band 28 in an exemplary embodiment has sufficient elastic strength to permit stretching of its loop having an inner circumference defined by aperture 36 to at least three times the size of the relaxed, unstretched inner circumference without fracture of the elastic material. The relaxed, unstretched inner circumference will vary depending on the size of the opening desired for the loop. The relaxed unstretched inner circumference typically ranges from about 1.5 inches (3.8 cm) up to about 10 inches (25.4 cm) but is not limited to this typical range. In this disclosure, the term "circumference" is loosely used to refer to a perimeter of a closed shape and thus is applicable for describing an edge of an oval, elliptical or other closed polygon or shape (whether symmetrical or asymmetrical) that may or may not be circular.

A width dimension D of elastic band 28 between aperture 36 and outer perimeter cut 34 is adequate to provide requisite strength for the elastic band 28 as it is placed about a product or bundle of products, such as produce that is sold in clumps or groups, for example (not shown). As shown in FIG. 7, an average loop width dimension D for elastic band 28 in exemplary embodiments falls within a range of at least 100 mils (2.54 mm) (generally at least about ⅛ inch or 125 mils or 3.18 mm) up to about ½ inch or about 500 mils (12.7 mm). These widths are especially suitable for thicknesses of elastic strip 30 between about 0.012 inch (12 mils or 0.30 mm) and 0.030 inch (30 mils or 0.76 mm).

In an exemplary embodiment, materials for forming the elastic strip 30 are rubber-like in character. The material desirably recovers from a stretched condition relatively quickly; however, instantaneous retraction or recovery to an original relaxed condition and dimension after stretching is not always critical for functional elastic performance. Substantially instantaneous retraction to a loop inner circumference dimension (defined by aperture 36) no greater than 5 percent above the original unstretched loop inner circumference dimension suffices for a multitude of uses. A substantially instantaneous loop retraction is accomplished when, after having been momentarily stretched to a predetermined extent, it takes no more than 3 seconds for the loop to retract (i.e., recover) to an inner circumference size no more than 5 percent greater than the inner circumference of the original unstretched loop. A momentarily stretched condition is one in which the stretch is not held for more than 3 seconds, and the predetermined extent of the stretch is three times (or more) the inner circumference of the loop in unstretched relaxed condition. There may be occasions where retraction may take possibly up to about 10 seconds and still may constitute sufficiently quick retraction to be useful as elastic material for the purposes of this disclosure. Those skilled in the art of elastic performance features are capable of selecting materials such as elastomers possessing the elastic stretch and retraction characteristics desired for a particular use.

In selecting materials such as elastomers for elastic strip 30, substantially instantaneous retraction is most preferred for rapid bundling of products; slower retraction may allow some product to fall out of the bundle before retraction takes place. On the other hand, a modestly slower retraction may be quite adequate where elastic band 28 is to be stretched about a single product under conditions where speed of retraction (bounce back) is reliable but not the dominant consideration.

Suitable elastomers include natural and synthetic elastic materials, including rubber, vulcanized rubber, and thermoplastic elastomers. Particularly suitable elastomers are those that are thermoplastic in that they at least soften in response to heat, or even melt, to a flowable or moldable state. A multitude of thermoplastic elastomers are known and more are being created. A suitable family of thermoplastic elastomers includes styrenic block copolymers. This family includes styrene-butadiene styrene and styrene-ethylene-butylene styrene. Another family of useful thermoplastic elastomers include olefinic elastomers, including those that are ethylene based as well as those that are polypropylene based (e.g., where interposed different monomer blocks are not used but blocks of different tacticity—atactic and isotactic—are created by using metallocene catalysis polymerization). Yet another family of thermoplastic elastomers include polyvinyl chloride-based elastomers. Still other families of thermoplastic elastomers can be based on urethanes, nylon, and silicon, for example.

Figure 9:
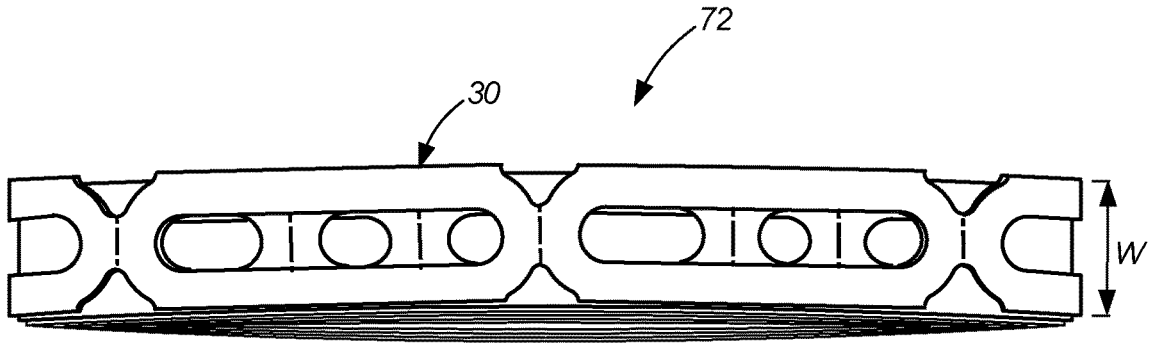
FIG. 9 is a top view of a second exemplary spool including the elastic strip of FIG. 7.
Figure 8:
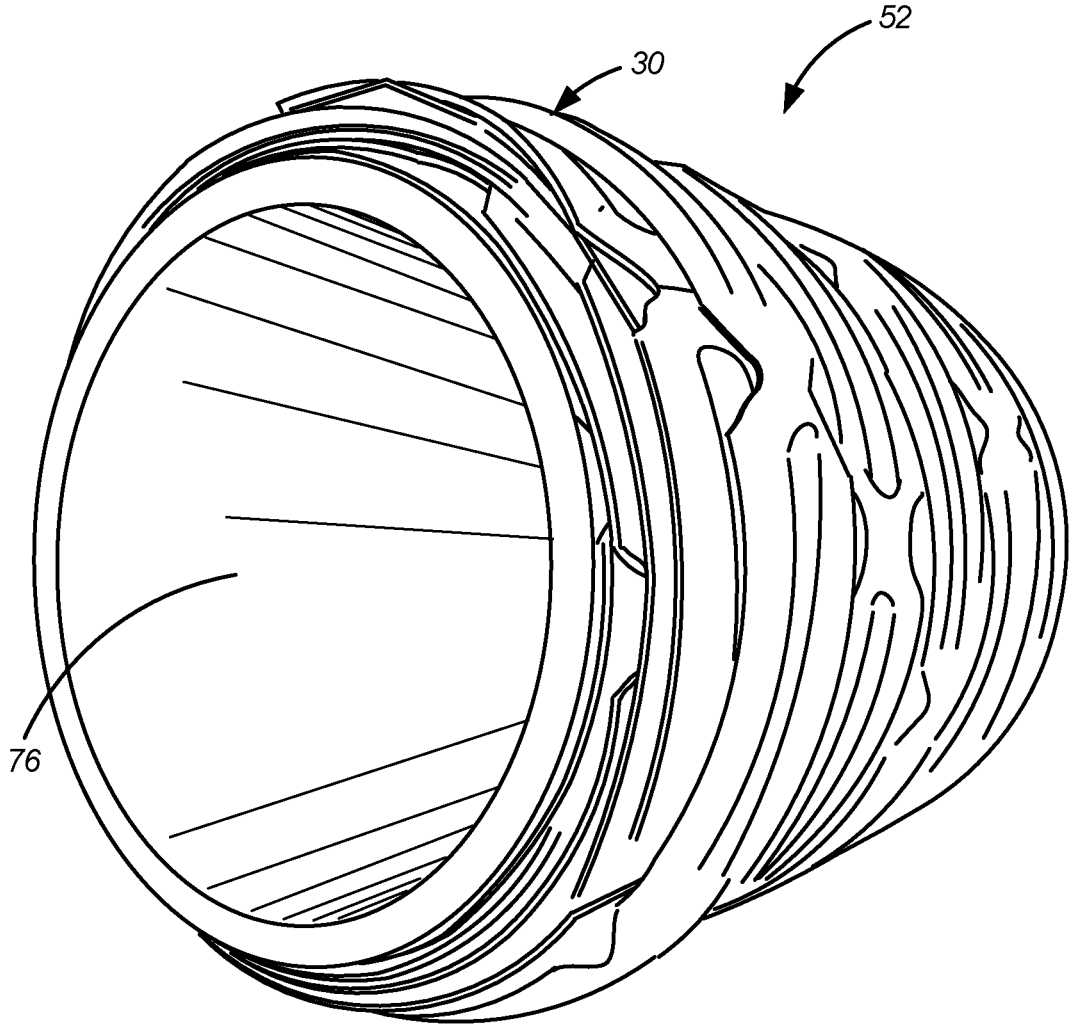
FIG. 8 is a perspective view of a first exemplary spool including the elastic strip of FIG. 7.

FIG. 7 is a top view of a portion of a strip 30 of indefinite length of rupturably connected elastic bands 28. As shown in FIGS. 8 and 9, elastic strip 30 can be provided in a spooled configuration, formed by rolling an elastic strip 30 of indeterminate upon a spool core 76 or upon itself. FIG. 8 is a perspective view of a embodiment of a spool 52, having a core 76 of greater width than the width W of strip 30. Such a spool configuration is especially useful when a very long strip 30, containing a high number of elastic bands 28, is desired. By winding strip 30 about a core 76 having a greater width, the thickness of the wound strip 30 upon core 76 can be reduced relative to that of the spool 72 shown in FIG. 9, thereby allowing for easier handling of the spool 52. FIG. 9 is a perspective view of a spool 72 including a rolled configuration of strip 30 that is wound upon an optional core and upon itself and in a manner so that a width of the spool 52 is substantially the same as the width W of a single elastic band 28.

In use, dispenser 10 may be mounted with a spool holder such as in assembly 46 shown in FIGS. 4 and 5 or assembly 62, shown in FIG. 6, for example. Such an assembly may be mounted to a convenient location in a packaging facility, or carried on a user's person such as on a utility belt, for example. As shown in FIG. 2, with a penultimate elastic band **28*b* constrained by stop element 26, a user can then use one hand to tug gently at the individual end elastic band 28*a* of strip 30 to rupture the joints 74 holding that band 28*a* to the rest of strip 30. Thus, an individual band 28 is easily removed for use without requiring a user to untangle a single band from a mass of tangled bands. As shown in FIGS. 3A-3B, to dispense the next connected band 28*b*, a user may lift up on the constrained band 28*b* and pull in direction 39 to allow passage of the strip 30 through gap 40 between stop element 26 and end 42 of cover 14. Thus, the next elastic band at 28*c* may be moved (e.g., advanced or indexed) so that its aperture 36 is lowered onto stop element 26, and now the last band 28*b* is unconstrained and available for removal from the strip 30. Thus, dispenser 10 allows for sequential dispensing of individual bands 28 from a strip 30 of rupturably connected bands. After all the bands 28 of a strip 30 have been removed, the spool core 76 (shown in FIG. 8) can be removed from shaft 50, 68 and a new spool 52, 72 can be mounted thereon for use. While particular embodiments of dispenser assemblies 46, 62 are illustrated, it is contemplated that spool 52, 72 can be attached to any of a variety of holders for use with dispenser 10**.

Figure 10:
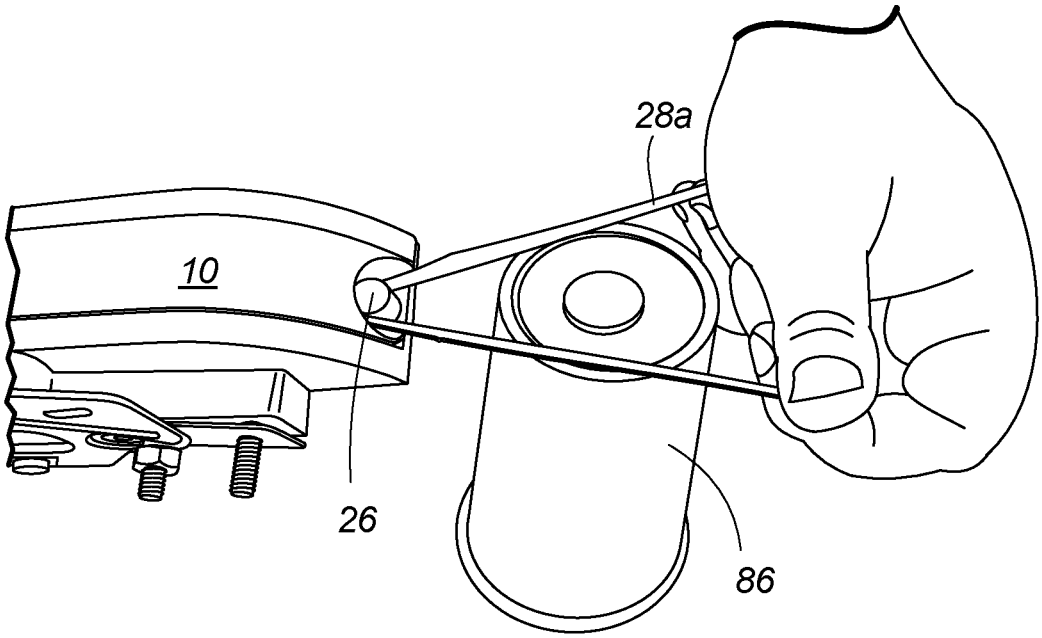
FIGS. 10-13 are perspective views of sequential steps illustrating the use of an exemplary dispenser in an exemplary method to place an elastic band about a product.
Figure 11:
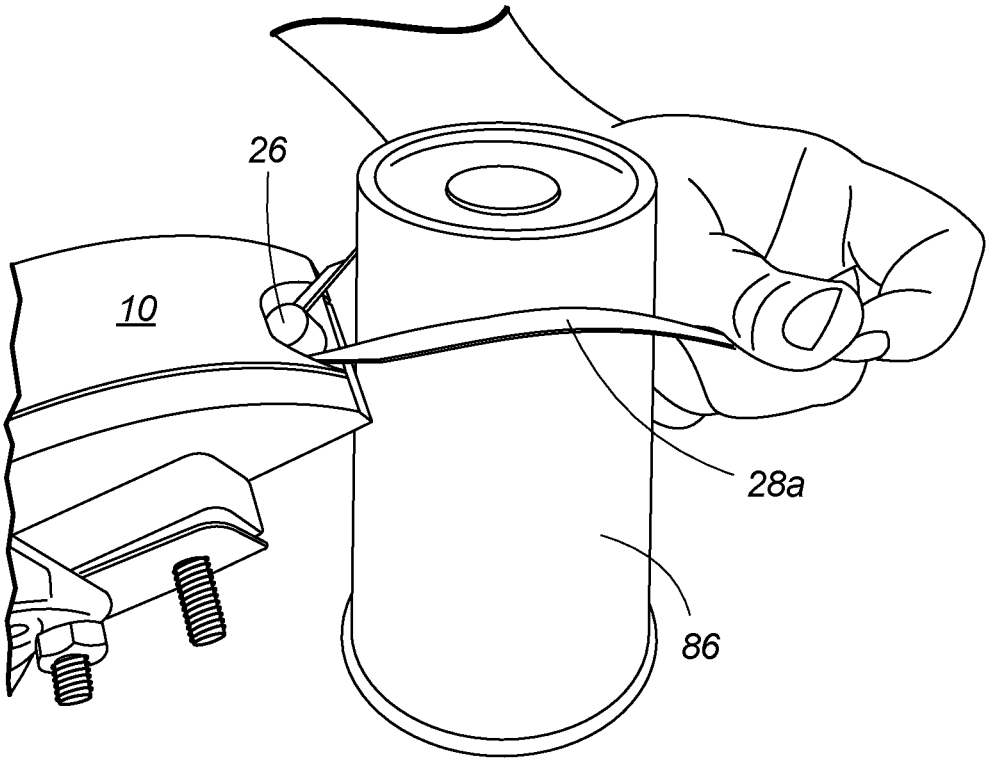

FIGS. 10-13 illustrate sequential steps in an exemplary method for using dispenser 10 to place an elastic band 28 about a product 86. As illustrated, product 86 appears to be a single item. However, it is contemplated that the illustrated method can also be used to bundle a plurality of items together as a product within a single elastic band 28. As shown in FIG. 10, a last band **28*a* of a connected strip of elastic bands (such as elastic band 30 discussed above) is constrained at dispenser 10 by stop element 26. Thus held, a user can use a single hand to grasp elastic band 28***a* and stretch it about product 86. As shown in FIG. 11, the user can then pull band 28*a* to a desired position on product 86, still with one hand, as the other side of band 28*a* remains connected to dispenser 10 at stop element 26.

Figure 12:
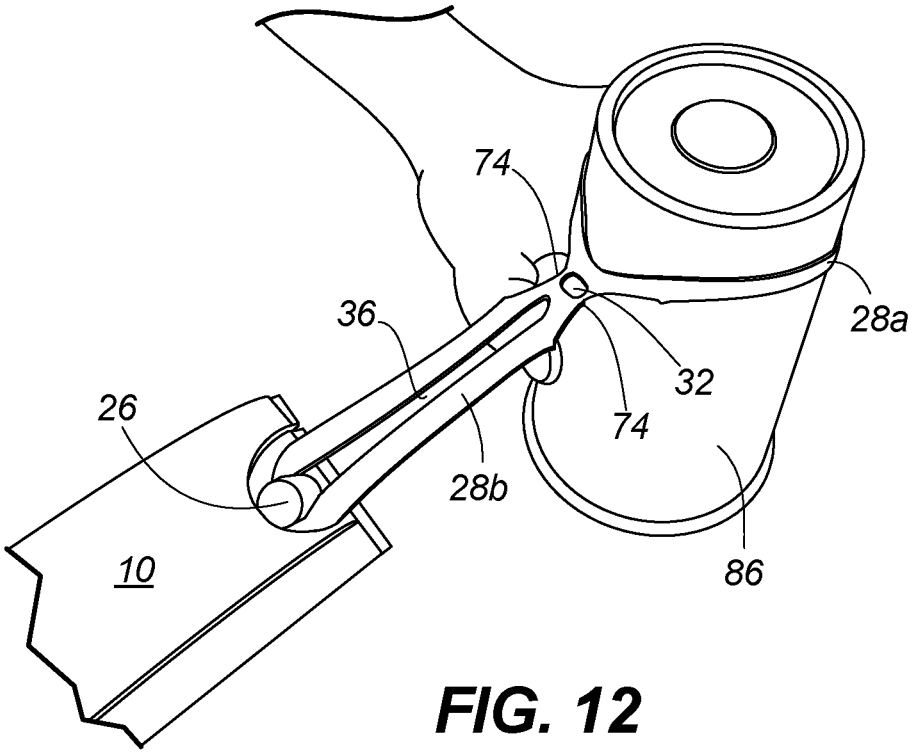
Figure 13:
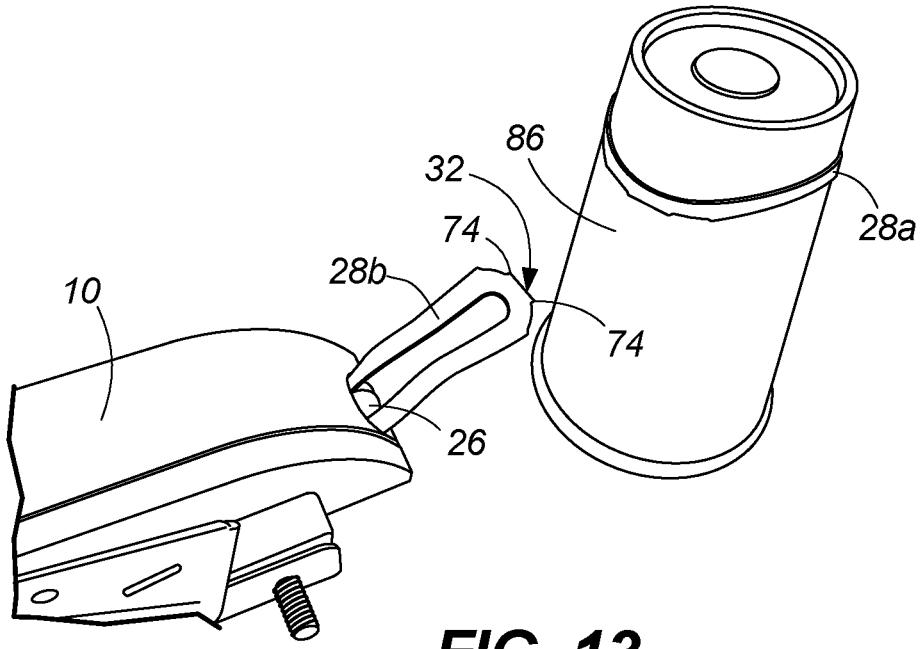

With reference to FIG. 3B, the user can tip dispenser 10 downward to allow elastic band 28*a* to be released from stop element 26, thereby allowing a portion of the next connected band 28*b* to pass through gap 40. The user can then tip dispenser upward again so that aperture 36 of next band 28*b* can be caught by stop element 26, as shown in FIGS. 2 and 12. With reference to FIG. 13, the user can pull dispenser 10 away from product 86, thereby breaking the rupturable joints 74 at ends 32 between the adjacent elastic bands 28*a* and 28*b*. The process shown in FIGS. 10-13 can then be repeated using a single hand to place an elastic band about many products 86 in sequence quickly, easily, and without having to untangle an individual band from a bundle of many such bands.

Those skilled in the art will readily recognize that the teachings of this disclosure may be embodied in specific forms other than those illustrated without departing from the essential described characteristics. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. An assembly configured for use with a chain of rupturably connected elastic bands, the chain provided on a spool, each of the bands having an aperture therethrough, wherein the assembly includes:

a dispenser including:

a base including:

two spaced-apart side walls;

a fixed convex surface between the two side walls, wherein the chain of bands is configured to be drawn along a chain travel path from a first side of the fixed convex surface to a second side of the fixed convex surface; and a stop element positioned proximate the second side of the fixed convex surface; and a cover having an interior concave surface, the cover having a closed position wherein a channel is defined between the interior concave surface, the two side walls, the fixed convex surface, and the stop element;

wherein a portion of the chain travel path is defined through the channel;

wherein the chain is advanced on the chain travel path by pulling the chain in a first direction proximate the stop; and wherein the chain is stopped from advancing on the chain travel path by pulling the chain in a second direction proximate the stop that is different from the first direction, and wherein pulling the chain in the second direction inserts the stop element into the aperture of one of the elastic bands; and a shaft positioned below the base and configured to support the spool.

2. The assembly of claim 1, further including a mount on which the dispenser and shaft are attached.

3. The assembly of claim 2, wherein the mount includes a wall on which the dispenser and shaft are attached.

4. The assembly of claim 3, wherein the mount further includes a floor oriented substantially perpendicular to the wall.

5. The assembly of claim 1, further including a handle.

6. A method for dispensing elastic bands from a chain of rupturably connected elastic bands with an assembly, each of the bands having an aperture therethrough, the chain being provided on a spool, the method including:

mounting the spool on a shaft of the assembly;

positioning a portion of the chain through a dispenser of the assembly that includes:

a base including:

two spaced-apart side walls;

a fixed convex surface between the two side walls; and a stop element positioned proximate the second side of the fixed convex surface; and a cover having an interior concave surface, the cover having a closed position wherein a channel is defined by the interior concave surface, the two side walls, the fixed convex surface and the stop element;

wherein the positioning of the portion of the chain through the dispenser includes disposing the portion of the chain in a channel between the stop element, the fixed convex surface, the two side walls, and the interior concave surface, wherein a surface of the chain contacts the fixed convex surface;

pulling the chain outside the assembly in a first direction to move the chain through the channel and in contact with the fixed convex surface so that first and second elastic bands of the chain are pulled past the fixed convex surface; and pulling the chain outside the assembly in a second direction that is different from the first direction to insert a stop element into the aperture of the second elastic band, so that the first elastic band is outside the assembly.

7. The method of claim 6, further including pulling the first elastic band to sever a connection between the first elastic band and the second elastic band.

8. The method of claim 6, further including:

lifting the second elastic band to free its aperture from the stop element;

pulling the chain in the first direction; and inserting the stop element into the aperture of a third elastic band, so that the second elastic band is outside the assembly.

9. The method of claim 6, including moving the cover relative to the base.

10. The method of claim 9, wherein moving the cover relative to the base includes pivoting the cover about a pivot axis.

11. The method of claim 6, including stretching the first elastic band about an item so that at least a portion of the item is inserted into the aperture of the first elastic band.

12. The method of claim 6, including stretching the second elastic band about an item so that at least a portion of the item is inserted into the aperture of the second elastic band.

13. The method of claim 6, including tipping the dispenser.

* * * * *